US006061915A

United States Patent [19]

Seigneur et al.

[11] Patent Number: 6,061,915

[45] Date of Patent: May 16, 2000

[54] TIGHTENING MECHANISM FOR CHAIN SAW GUIDE BAR

[75] Inventors: Christopher David Seigneur, West Linn; Kent L. Huntington, Molalla; Mark D. Lamey, Gresham, all of Oreg.

[73] Assignee: Blount, Inc., Portland, Oreg.

[21] Appl. No.: 09/075,151

[22] Filed: May 8, 1998

Related U.S. Application Data

[63] Continuation-in-part of application No. 08/944,933, Oct. 2, 1997.

[51] Int. Cl.[7] ..... B27B 17/14

[52] U.S. Cl. ..... 30/386; 30/383

[58] Field of Search ..... 30/381, 383, 385, 30/386; 83/814, 816

[56] References Cited

U.S. PATENT DOCUMENTS

| | | | |
|---|---|---|---|
| 2,289,123 | 7/1942 | Jones . | |
| 2,532,981 | 12/1950 | Wolfe . | |
| 2,765,821 | 10/1956 | Strunk . | |
| 2,774,395 | 12/1956 | Tweedie . | |
| 3,327,741 | 6/1967 | Merz | 30/386 |
| 3,382,898 | 5/1968 | Walker . | |
| 3,457,970 | 7/1969 | Locati . | |
| 3,636,995 | 1/1972 | Newman . | |
| 3,647,270 | 3/1972 | Althaus . | |
| 3,866,320 | 2/1975 | Progi . | |
| 3,901,563 | 8/1975 | Day . | |
| 4,129,943 | 12/1978 | Bricker . | |
| 4,269,099 | 5/1981 | Saito . | |
| 4,316,327 | 2/1982 | Scott . | |
| 4,361,960 | 12/1982 | Halverson . | |
| 4,382,334 | 5/1983 | Reynolds . | |
| 4,486,953 | 12/1984 | Halverson . | |
| 4,563,817 | 1/1986 | Leighton . | |
| 4,567,658 | 2/1986 | Wissmann . | |
| 4,819,335 | 4/1989 | Alexander . | |
| 4,835,868 | 6/1989 | Nagashima . | |
| 4,920,650 | 5/1990 | Edlund . | |
| 4,999,918 | 3/1991 | Schliemann . | |
| 5,174,029 | 12/1992 | Talberg . | |
| 5,491,899 | 2/1996 | Schliemann . | |
| 5,497,557 | 3/1996 | Martinsson . | |
| 5,896,670 | 4/1999 | Gibson et al. | 30/386 |

FOREIGN PATENT DOCUMENTS

| | | |
|---|---|---|
| 1329966 A1 | 3/1985 | Russian Federation . |

*Primary Examiner*—Hwei-Siu Payer
*Attorney, Agent, or Firm*—Robert L. Harrington

[57] ABSTRACT

A chain saw guide bar including a chain tightening mechanism. A shaft or rack slidable within the bar body includes a head portion slidable rearwardly against a bar mounting stud. The head portion resides between opposed edges formed in the bar body and the head portion includes fingers that straddle the mounting stud. Rearward sliding of the shaft or rack against the stud produces a lateral force urging spreading of the fingers to produce wedging of the fingers between the opposed edges and the stud. Such wedging of the fingers produces resistance to return sliding of the shaft and retains the tightened condition of the chain.

12 Claims, 4 Drawing Sheets

TIGHTENING MECHANISM FOR CHAIN SAW GUIDE BAR

This is a continuation-in-part of U.S. Ser. No. 08/944,933 pending filed Oct. 2, 1997.

FIELD OF THE INVENTION

This invention relates to a chain saw and more particularly it relates to a mechanism provided for the guide bar that allows mounting of a saw chain loop onto a guide bar and drive sprocket of a chain saw and then the tightening of the chain as desired for optimum cutting.

BACKGROUND OF THE INVENTION

A loop of saw chain is not elastic for the purpose of mounting it on a chain saw. The typical arrangement is for a guide bar to be mounted to have linear adjustment relative to a fixed drive sprocket. By moving the bar toward the drive sprocket, the chain can be readily mounted in a circular path around the bar and sprocket. In such condition the chain is loose and will be thrown off the bar if cutting is attempted. Thus the bar is moved away from the drive sprocket until the chain is properly tightened and at that position the bar is clamped against the chain saw housing.

The chain has to be periodically replaced. It also, from time to time, can become loosened during use and the user has to retighten it by further movement of the bar away from the drive sprocket. The tightening process is important for both performance and safety and is a significant feature of a chain saw.

Whereas typically the tightening mechanism has been provided on the chain saw housing (a threaded screw having a finger engaged with the guide bar moves the bar toward and away from the drive sprocket), such a mechanism has been a problem for users and an alternate tightening mechanism has been developed. See the disclosure of commonly owned U.S. patent application Ser. No. 08/944,933. The present invention is an improvement to this alternate mechanism and the disclosure of the above application for patent is incorporated herein by reference.

BRIEF DESCRIPTION OF THE INVENTION

The prior mechanism includes a rack and pinion mechanism that is mounted in the center or core laminate of a laminated guide bar. The core laminate is provided with an elongated slot in which a toothed rack is provided. A pinion having teeth in engagement with the rack teeth is manually rotated to force the rack against a mounting stud to drive the bar away from the mounting stud and thus away from the drive sprocket in a tightening operation.

The particular issue here addressed is the feature for holding the tightened condition of the bar while clamping the bar in place to the chain saw housing. In the preferred embodiment of the present invention, the rack is provided with a wedging action. The rear end of the rack is fork-shaped whereby fingers or prongs straddle the mounting stud. The fingers define a V-shape and the stud engages the sides of the fingers at a mid point (spaced from the apex or juncture of the fingers) where the resistive force applied to the fingers urges spreading of the fingers. The rack is split so that such spreading is permitted. The exterior edges of the fingers are slightly tapered as are the sides of the slot in the core.

In operation the rack is forced rearwardly against the stud to drive the bar in a forward direction for tightening of the saw chain. As the tightened condition is reached, the bar resists further movement and the stud spreads the fingers in a wedging action against the tapered sides of the core slot. Such wedging action provides lock up of the bar in its forward position relative to the drive sprocket, at the precise point of tightening. It does not rely on teeth spacing, i.e., the relation of the pinion and rack teeth and securely holds the bar in place while clamping of the bar to the housing takes place.

The wedging action is considered uniquely applied for the purpose of bar tightening and is adaptable to other than a rack and pinion combination. The invention and variations will be more fully appreciated upon reference to the following detailed description and accompanying drawings.

DETAILED DESCRIPTION OF THE INVENTION

Figure 1:
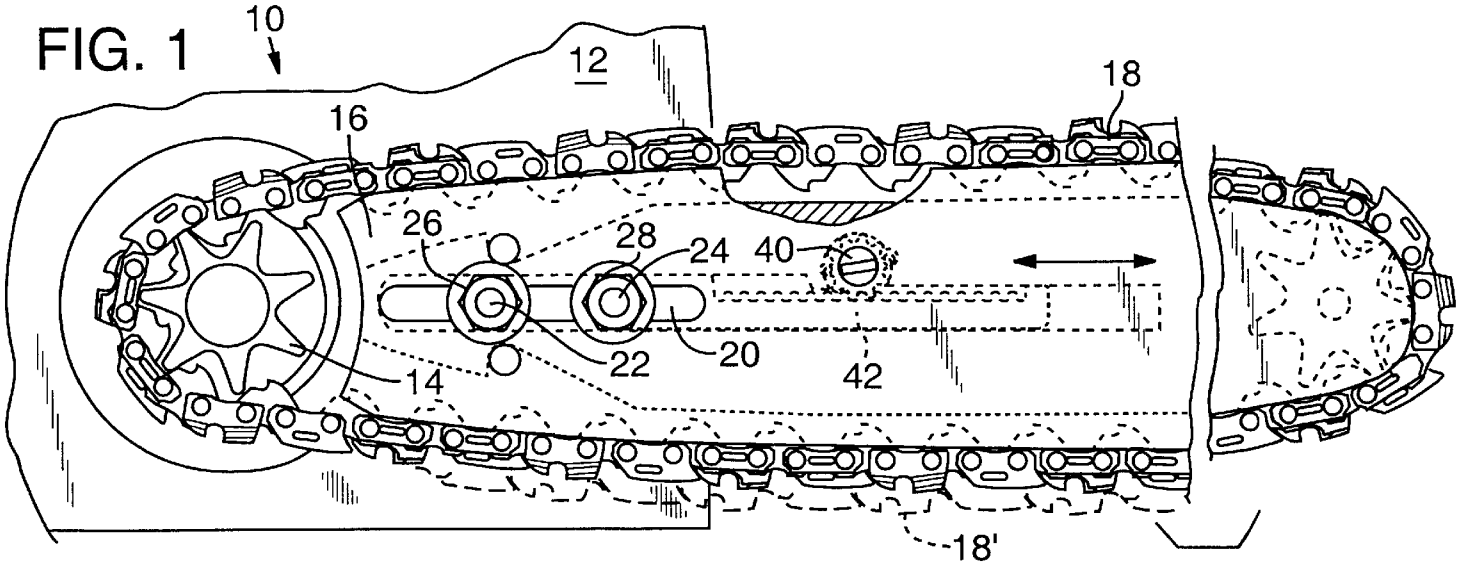
FIG. 1 is a view of an assembled chain saw including a guide bar of the present invention.

Reference is made to FIG. 1 which illustrates a chain saw 10 which includes a power head (shown in part only) having a housing 12 and a drive sprocket 14. A saw chain guide bar 16 is mounted to the housing 12, the rear end of which is spaced from the drive sprocket 14 and extends axially away from the drive sprocket to extend beyond the housing 12 as shown. A continuous loop of saw chain 18 extends around the drive sprocket 14, along a top edge of the guide bar 16 and around the outer end or nose of the bar, back along the bottom edge of the bar and back onto the drive sprocket.

The saw chain is flexible in the plane of the bar as permitted by the pinions or rivets that connect the links of the saw chain together. However, it is not elastic such as to permit stretching of the chain loop for mounting of the chain to the bar and sprocket. Such mounting of the saw chain is accomplished by sliding the bar rearward, i.e., closing the space between the rear end of the bar and the sprocket. Such sliding of the bar is permitted by the manner in which the bar is mounted to the housing. As shown, the guide bar is provided with an axially extended slot 20 that is mounted on a pair of threaded studs 22, 24. A pair of clamping nuts 26, 28 are screwed onto the studs 22, 24. Loosening the nuts 26, 28 permits sliding of the bar 16. (This same arrangement can have a cover enclosing the bar end. This and other variations of securing/clamping mechanism, is encompassed by the invention.)

In operation, i.e., when a loop of saw chain 18 is to be mounted onto the chain saw, the nuts 26, 28 are loosened and the bar is slid axially rearwardly. This permits the saw chain to be entrained around the drive sprocket 14 and along the edges of the guide bar. The guide bar is then slid forwardly, again as permitted by the slot 20 and loosened nuts 26, 28. When the chain is properly tightened or tensioned, the nuts are tightened and the chain saw is ready for cutting. Whereas the above description relates to the mounting of the chain to the bar, a similar sliding of the bar and thereby tightening of the saw chain may be required from time to time during use. For example, chain or bar wear may require a repeat of the tightening process.

What has not been described above is the mechanism which accomplishes the sliding of the bar on the mounting studs. Whereas such sliding may be accomplished manually, e.g., placing a screwdriver blade in the slot 20 and manually pushing the bar forwardly, such is not satisfactory at least in part because the bar needs to be held in a taut condition while the clamping nuts are tightened. The industry in general is in agreement that a tightening mechanism is desired and such mechanism has been in use for many years. The present invention improves upon the prior tightening mechanism.

Figure 2:
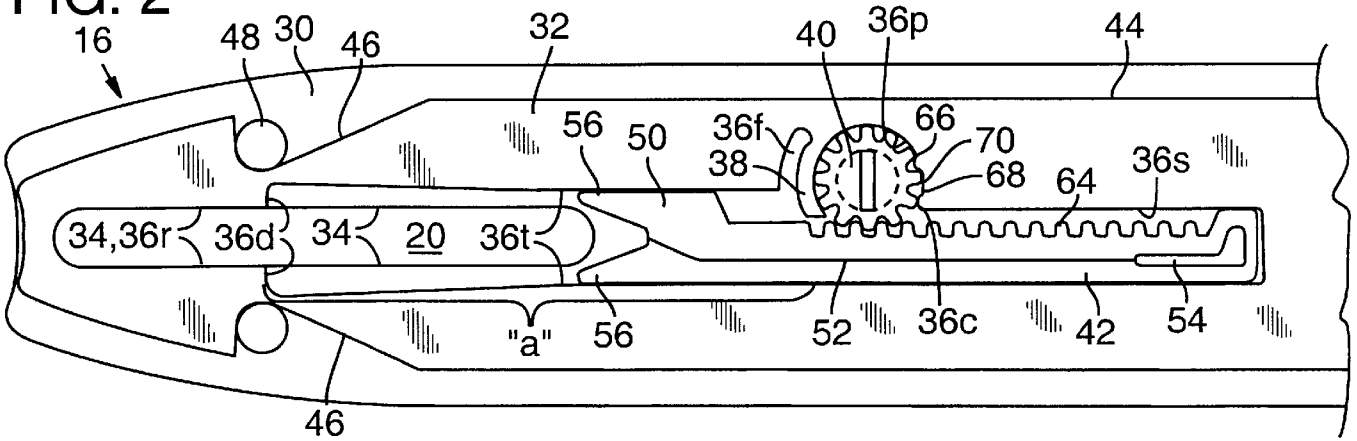
FIG. 2 is a view of the guide bar of FIG. 1 in a non-assembled condition and sectioned to expose the chain saw tightening mechanism thereof.

FIG. 2 illustrates the preferred embodiment of the guide bar 16 including a tightening mechanism of the invention. (The tightening mechanism is partially illustrated in FIG. 1 but in dash lines.) A laminated bar includes two side laminates 30 and a center or core laminate 32 secured together, e.g., by welding. The near side laminate has been removed for illustration purposes and FIG. 2 thus illustrates core laminate 32 mounted on the opposite side laminate 30. The slot 20 through the side laminate 30 is defined by edge 34. A slot along the length of core laminate 32 is defined by edge 36 (referred to with sub-titles, e.g., $\mathbf{36}_t$, $\mathbf{36}_r$, etc.). As will be apparent from the repeated reference numbers, edge 36 departs both laterally and axially from slot 20 and its configuration is varied to accommodate the various tightening components and to cooperatively participate in the tightening process as will be explained.

At the rearward most end of the center core slot, edge 34 of the slot 20 and edge $\mathbf{36}_r$ are similar. At $\mathbf{36}_d$, the core slot edge departs from the slot 20 configuration, and at $\mathbf{36}_t$, the core slot extends forwardly along section "a" in a converging taper, e.g., of 1.5 degrees. At $\mathbf{36}_f$, the core slot is configured to provide a spring finger 38 and edge portion $\mathbf{36}_p$ provides a cavity for housing pinion 40. At $\mathbf{36}_c$ edge 36 defines a depression or notch which will be later explained and edge $\mathbf{36}_s$ provides sliding movement of rack 42.

The remainder of the configuration of core laminate 32 is generally conventional. The outer edge 44 is inset to provide an edge groove in the bar for receiving the drive tangs of the saw chain. At the rear end of the bar, the J-shape 46 of outer edge 44 surrounding hole 48 of the side laminate provides access for inserting oil through the opening 48 and into the edge groove for lubricating the saw chain.

FIG. 2 further illustrates a rack 42 slidably positioned in slot portion $\mathbf{36}_s/\mathbf{36}_t$ of cavity 36 with a forked head portion 50 at the trailing end of the rack. The rack 42 is provided with a split 52 that extends substantially the length of the rack to a formed opening 54. This split permits opening of prongs 56 of the forked head portion 50 as will be explained.

The chain tightening process is explained with reference to FIGS. 3 and 4 which are views similar to FIG. 2 but showing the tightening mechanism in relation to the mounting studs 22, 24, i.e., as would occur with the bar mounted on the chain saw shown in FIG. 1. The reader will appreciate that prior to tightening, the chain loop is entrained around the bar and sprocket as shown in FIG. 1 but with the chain in a loosened condition as generally indicated by dash line 18' in FIG. 1. As explained, this condition may have resulted from chain stretch as caused by wearing, or if a new chain has been mounted on the saw.

Figure 3:
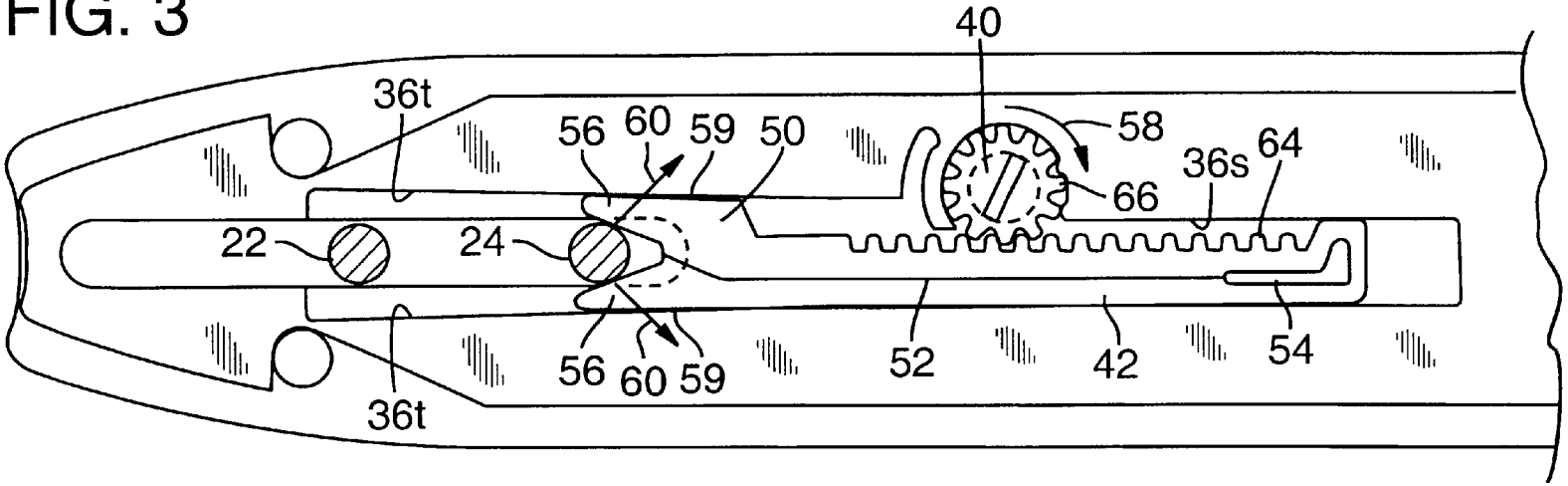
FIGS. 3 and 4 are views similar to FIG. 2 but illustrating the chain tightening mechanism acting against a mounting stud of the chain saw housing.
Figure 4:
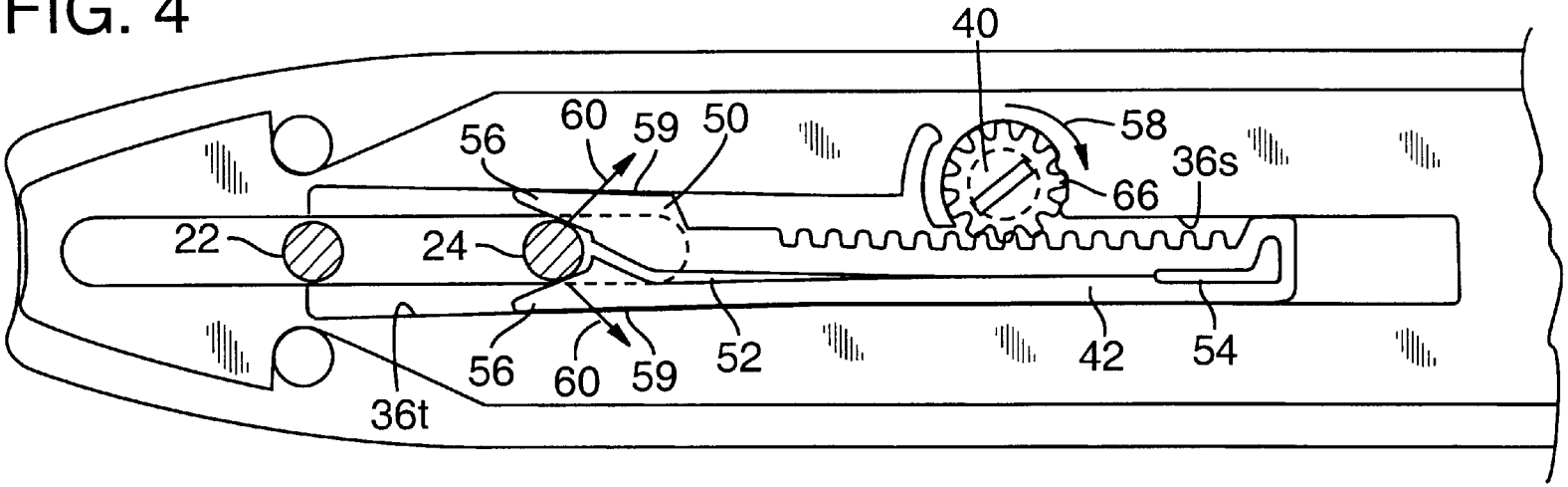

Referring now specifically to FIG. 3, the forked head 50 of the rack 42 is provided with prongs 56. The configuration of the prongs 56 is such as to engage the stud 24 at a forward position as shown in FIG. 3, i.e., whereby the rearward thrust of the rack (generated by turning the pinion 40 clockwise indicated by arrow 58 as applicable only to the manner in which they are illustrated in the drawings) produces a force vector of resistance by the stud 24 that is directed forwardly and outwardly as indicated by arrow 60. The taper of the edge $\mathbf{36}_t$ of the core slot permits gradual opening of the prongs 56 or jaws of the forked head portion as the rack 42 moves rearward relative to the bar. As long as the bar moves relatively easily, the rack will continue to move rearward, the jaws will continue to open, and the chain will be tightened to remove the slack as illustrated by the dash lines of FIG. 1.

When the saw chain slack is used up, the resistance to the bar movement immediately peaks. Further movement of the rack against the stud 24 generates wedging of the prongs or jaws between stud 24 and the tapered edges $\mathbf{36}_t$ which is the condition illustrated in FIG. 4. As will be noted, the prongs or jaws 56 have an outer surface 59 that is substantially parallel to the edges $\mathbf{36}_t$ and the wedging action produces frictional engagement as between the head portion and the edges $\mathbf{36}_t$ to produce an instantaneous lock up (at the point whereat the chain is in a tightened condition) whereby withdrawal of the rack away from the stud is strongly resisted. This resistance provides retention of the tightened condition of the chain while the locking nuts 26, 28 are screwed down against the bar to clamp the bar against the housing 12. However, because of the shallow angle of the taper, the user can readily overcome the lock up position by reverse turning of the pinion, e.g., for bar replacement.

A further benefit of the V-shaped configuration of the prongs or jaws 56 is that it produces a desired centering of the bar. The tightening process is often accomplished with the chain saw in an upright position, i.e., the position of FIG. 1. With the clamping nuts loosened and prior to tightening, the cantilever effect of the extended bar nose produces (due to the weight of the bar) a downward force at the nose end of the bar. The mounting studs 22, 24 cooperatively limit the amount of nose movement up or down but there is typically sufficient tolerance as between the studs 22, 24 and the slot 20 that some drooping of the guide bar occurs with the slot engaging the top of the stud 24 and the bottom of the stud 22. During the wedging action with the prongs or jaws forced against the stud 24, the stud 24 is centered in the V of the prongs and thereby is centered in the slot 20. The nose is accordingly raised into the desired alignment with the chain saw.

In a prototype design of the above-described guide bar, and with the split 52 closed, the head portion 50 was provided with a 30 degree included angle between the inside edges of the prongs or jaws and the outside edges were provided with a 1.5 degree included angle similar to that of the slot $\mathbf{36}_t$. The jaws were designed to engage the periphery of the stud 24 at a point about one-third the distance inwardly from the tips of the jaws to the apex where the jaws become joined to the head. This relationship provides the desired lock up at the point of desired tightening although other configurations are expected to also perform satisfactorily.

Figure 5:
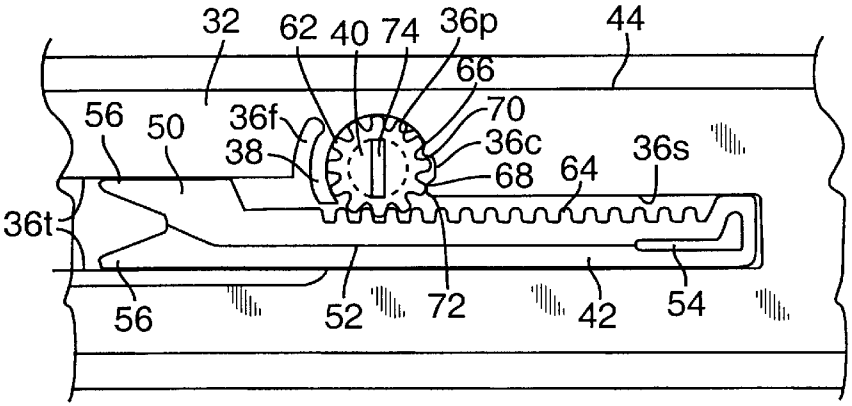
FIG. 5 is a view of a portion of the chain tightening mechanism of FIGS. 2–4.

Reference is now made to the pinion 40 contained in the cavity defined by edge configuration $\mathbf{36}_p$ as shown in FIG. 5. The pinion has as its primary function the linear movement of the rack 42. The pinion has peripheral teeth 62 that are in engagement with teeth 64 on rack 42. Rotation of the pinion 40 clockwise (indicated by arrow 58 in FIGS. 3 and 4) is achieved through engagement of slot 74 using a tool (e.g., a screwdriver), which produces forced movement of the rack, i.e., rearwardly toward the stud 24 as illustrated by a comparison of FIG. 3 with FIG. 4.

The pinion-cavity combination also provides a back up or secondary lock up. The notch defined by edge portion $\mathbf{36}_c$ is configured to provide inclined cam edges at 66 and 68 and a more abrupt edge at 70 and 72. The pinion 40 floats in the cavity $\mathbf{36}_p$ in the axial direction to a limited extent (permitted by the flexibility of the finger 38) and when the pinion 40 is forcing the rack 42 rearwardly into engagement with stud 24, the pinion 40 is urged toward the forwardmost position in the cavity with the forwardmost teeth 62 of the pinion projected into the notch formed by edge portion $\mathbf{36}_c$. The cam edges 66, 68 resistively permit successive teeth to enter and leave the cavity in a clockwise direction while the more abrupt edges 70, 72 substantially resist counter clockwise movement as long as the pinion 40 is being urged in the forwardmost position in the cavity. With the urging force reversed, the finger 38 will flex rearwardly to permit sufficient rearward movement of the pinion 40 to allow counter clockwise rotation of the pinion 40 and reverse sliding of the rack 42.

Figure 6A:
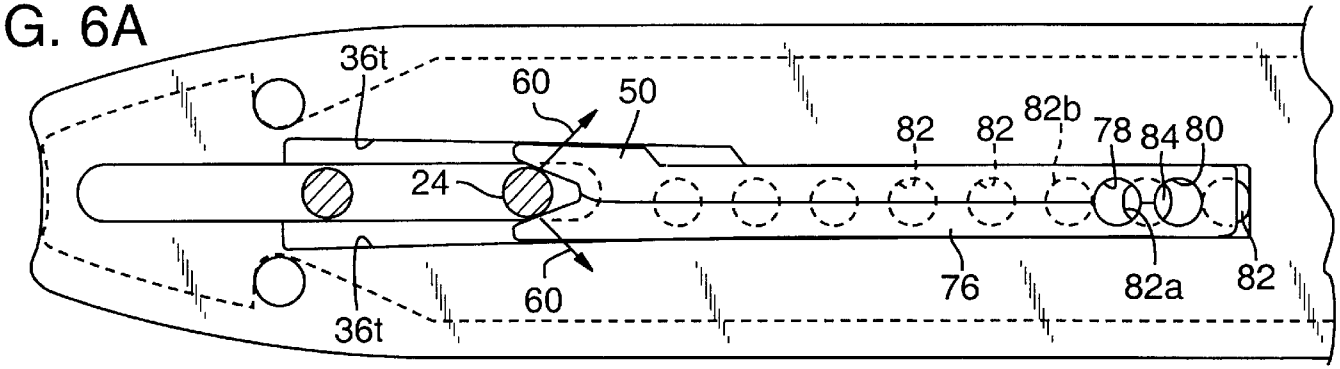
FIGS. 6A and 6B illustrate an alternate embodiment of the invention.
Figure 6B:
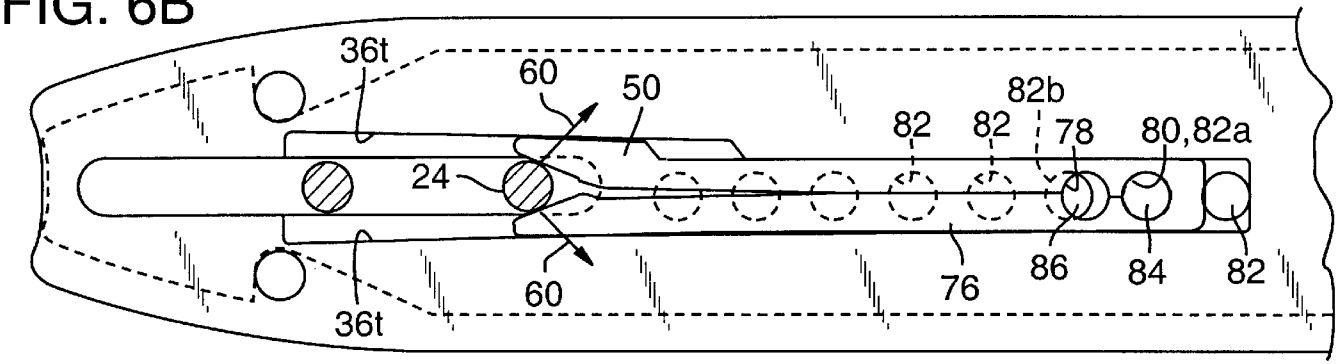

Reference is now made to FIGS. 6A and 6B which illustrate an alternate embodiment. As indicated for the embodiment of FIGS. 2–5, the primary function of the rack and pinion arrangement is to provide sliding movement of the forked head portion 50 of rack 42. The rack and pinion, as just explained, can provide a back up locking of the rack but such is not entirely satisfactory as the pinion will typically reverse turn a small amount before any tooth engages the edges 70, 72. The wedging action of the jaws or prongs 56 provides immediate locking at the forwardmost position. Essentially the back up or secondary locking feature is not considered a requirement.

There is likely a number of alternate ways that the forked head portion of the rack can be forced to move into the lock up position and the embodiment of FIGS. 6A and 6B is intended primarily to show a very simplified form of sliding action for the rack.

The rack 42 is replaced with an untoothed rack 76 hereafter sometimes referred to as a shaft 76. A pair of holes 78, 80 are provided at a rear portion in the rack 76 and similar holes 82 are provided in an outer laminate (or both outer laminates) of the bar. The spacings of the holes 78, 80 relative to the holes 82 are such that the rearward position of a hole edge of one of the holes 78, 80 is always exposed through one of the side laminate holes 82.

Referring to FIG. 6A, note that the rearmost edge of the hole 80 is exposed through laminate hole $\mathbf{82}_a$. A tool such as a screwdriver or the like can be inserted in the space 84 to urge the rack rearward, i.e., the blade can be positioned vertically in the space 84 and then turned to force the holes 80 and $\mathbf{82}_a$ into alignment as seen in FIG. 6B.

In FIG. 6B, it will be noted that now the rear edge of hole 78 in rack 76 is exposed through hole $\mathbf{82}_b$ of the outer laminate. The same process is used for the space 86 to advance the rack to a position where hole 78 and $\mathbf{82}_b$ are aligned.

Figure 7:
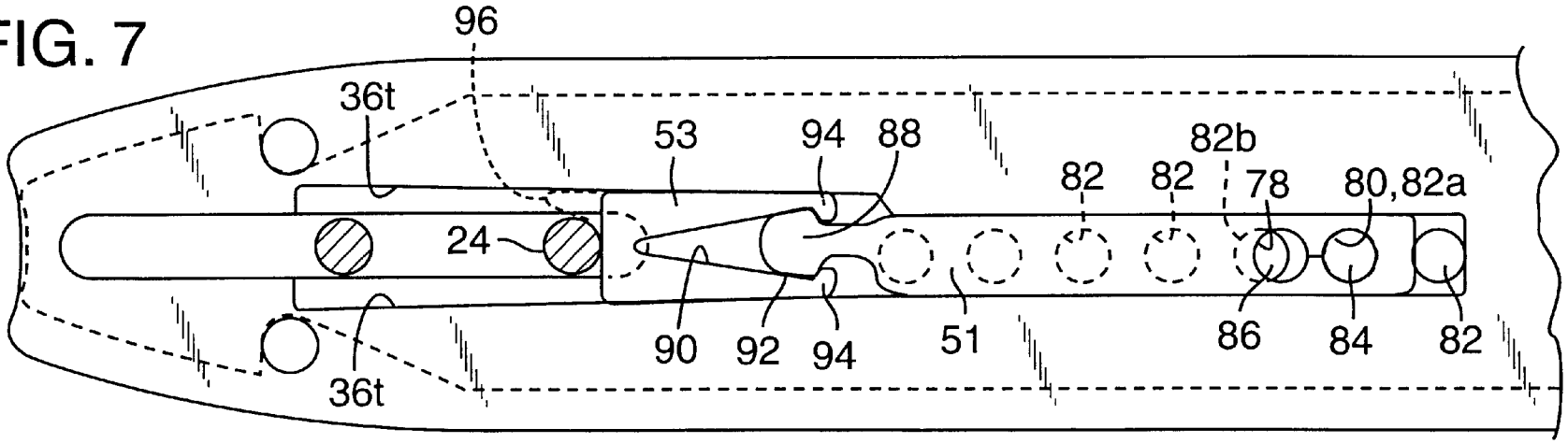
FIGS. 7 and 7A illustrate a further alternate embodiment.

From the above, it will be appreciated that a variety of concepts may be utilized for advancing the rack into engagement with the mounting stud to produce the wedging action that holds the bar taut while the clamping nuts are tightened. Also, the stud 24 does not have to be the mounting stud (any member fixed relative to the chain saw housing and engageable by the shaft or rack will suffice) or this function can even be provided by a projection (stud) from the shaft through a slot and engaging a lip or depression in the housing. Various other shapes of the rack head are also contemplated. A particular embodiment is illustrated in FIG. 7.

A shaft 51 similar to that of FIGS. 6A, 6B is illustrated and is slidably moved in a slot defined by edges $\mathbf{36}_t$ in the same manner as in FIGS. 6A, 6B. It will be appreciated, however, that the rack and pinion manner of sliding the shaft as shown in FIGS. 3–5 can also be applied to the locking mechanism of FIG. 7. The locking mechanism of FIG. 7 includes a separate sliding member 53 fixed to the head end 88 of shaft 51. The separate member 53 and head end 88 have mated inclining edges 90, 92. When the rear end of member 53 engages stud 24, the bar is moved forwardly until the saw chain is tightened whereby the fingers or prongs 94 are cammed (spread apart) outwardly against edges $\mathbf{36}_t$. Such produces the desired wedging effect that secures the bar in the tightened condition until the bar can be clamped to the housing of the saw. Whereas the prongs 94 are not in a position to center the bar as described in the prior embodiment, such centering can be provided by configuring the rear end of member 86 to have a nose portion 96 as shown in dash lines in FIG. 7.

Figure 7A:
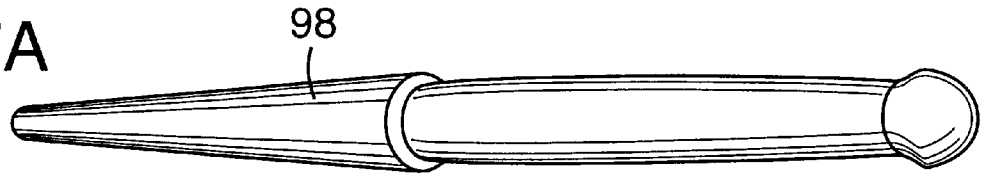

A still simpler concept of holding the bar in place is to use a tapered probe, e.g., a drift pin 98 as illustrated in FIG. 7A for insertion into the holes 78, 82. When the desired tightened condition is achieved, the drift pin is wedged in the aligned or partially aligned holes as a temporary holding mechanism until clamping is achieved. Accordingly, the invention is not to be limited to the embodiment shown but is encompassed by the definition of the claims appended hereto.

We claim:

1. A guide bar for a chain saw wherein the guide bar is mounted on a mounting stud of the saw in a manner that permits relative linear sliding for tightening of a saw chain entrained on the bar and a drive sprocket of the saw, said chain saw guide bar comprising:

an elongated body defining an axis along its length and having a saw chain guide edge extended around a top, a bottom and a front end of the bar, said body having a rear end to be mounted to said chain saw adjacent said drive sprocket, a mounting slot extended through the bar adjacent the rear end thereof and extended axially along the bar length and adapted to receive the mounting stud of the chain saw;

a cavity formed in the body and axially extended forward of the mounting slot and in communication with the mounting slot, a movable shaft entrapped in the cavity and slidable axially therein and having a rear end portion extended into the mounting slot and engaging the mounting stud of the chain saw with the bar mounted to the chain saw;

one of said cavity and slot defining opposed side edges, said rear end portion configured to have rearwardly projecting fingers each having opposed inner and outer edges, said fingers configured to straddle the mounting stud and the mounting stud engaging the inner edges of the fingers to urge spreading of the fingers when the shaft is forced against the stud, and said shaft in communication with the exterior of the bar to permit manual slidable movement of the shaft to force the rear end portion of the shaft against the mounting stud whereby the bar is moved to tighten the chain and the resistance to further tightening generating spreading of the fingers which become wedged between the stud and the opposed side edges.

2. A chain saw guide bar as defined in claim 1 wherein the shaft is split lengthwise from between the fingers and forwardly thereof whereby the spreading of the fingers is permitted by opening of the split.

3. A chain saw guide bar as defined in claim 2 wherein the side edges engaged by the fingers are tapered forwardly and inwardly whereby when in a tightened condition, forward movement of the shaft and the mounting stud relative to the bar is resisted.

4. A chain saw guide bar as defined in claim 3 wherein the outer edges of the fingers are configured to have a taper substantially matching the taper of the side edges when spread apart by the mounting stud.

5. A chain saw guide bar as defined in claim 1 wherein a second cavity is formed in the body intersecting said cavity, said second cavity configured to receive a pinion having peripheral teeth, said shaft having mated teeth along one edge and inter-engaged with the teeth of the pinion, said pinion exposed to the bar exterior for manual manipulation and turning of the pinion resulting in sliding of the shaft.

6. A chain saw guide bar as defined in claim 5 wherein the second cavity is configured to provide a substantially smooth wall interrupted by a notch, said pinion having free movement within the second cavity and said notch configured to engage the teeth of the pinion and provide a stop to resist turning of the pinion, said notch strategically positioned at a forward position of the second cavity whereby a rearward thrust on the bar induces positioning of the pinion forward in the cavity and engagement of the teeth of the pinion in the notch.

7. A chain saw guide bar as defined in claim 1 wherein the guide bar is formed of side laminates and a center laminate bonded together, said cavity provided in the center laminate and providing the opposed side edges.

8. A chain saw guide bar as defined in claim 7 wherein the shaft is provided with a plurality of holes along its length and the bar is provided with holes exposed to the bar exterior and in overlying non-registered relation with the holes in the shaft whereby the movement of the shaft in the bar is provided by a lever action that moves the hole positions of the shaft relative to the hole positions of the bar.

9. A guide bar for a chain saw wherein the guide bar is mounted to housing of the chain saw in a manner that permits relative linear sliding for tightening of a saw chain entrained on the bar and a drive sprocket of the saw followed by fixed clamping of the bar to the saw, said guide bar comprising:

an elongated guide bar body defining an axis along its length and having a saw chain guide edge extended around a top, a bottom and a front end of the guide bar body, said guide bar body having a rear end configured to be mounted to the chain saw at a position relative to the drive sprocket;

a movable shaft slidable axially in the bar, a slot in the bar receiving a fixed member from the chain saw that is extended through the slot and providing thereby for abutting engagement between the shaft and the chain saw whereby movement of the shaft relative to the bar produces movement of the bar relative to the drive sprocket of the chain saw for tightening the chain;

said shaft exposed to an exterior of the bar to permit manual urging between the shaft and the bar for chain tightening, and a holding mechanism holding the shaft in the tightened position and permitting thereby the fixed clamping of the bar to the housing.

10. A guide bar as defined in claim 9 wherein the shaft is provided with holes and the guide bar body is provided with mating holes, said holes in the shaft alignable with holes in the bar body and mated so that with a hole of the shaft coinciding with a hole in the bar body, a second hole of the shaft is only partially overlapped with a second hole in the bar body whereby a tool will force alignment of the second holes to force the rearward movement of the shaft.

11. A guide bar as defined in claim 10 wherein the tool is tapered and upon the shaft having reached the tightened condition, the tool is wedged into mated holes for providing the holding mechanism.

12. A guide bar as defined in claim 9 wherein the member extended through the slot is a member fixed to the chain saw, and wherein the holding mechanism comprises:

the shaft having a rearwardly facing head end and a slidable member slidable along opposing edges in the bar and between the head end and the member fixed to the chain saw, said slidable member having a front end that is V-shaped defining fingers and said head end forming a cam shape engaging said fingers whereby a rear end of the slidable member engages the fixed member and when movement is resisted, the interaction of the fingers and the head end produces wedging of the fingers against opposing side edges of the slot.

* * * * *